US006991120B2

(12) United States Patent
Gaillard

(10) Patent No.: US 6,991,120 B2
(45) Date of Patent: Jan. 31, 2006

(54) DEVICE FOR RAISING AND UNFOLDING THE MAST AND FOR RAISING THE JIB OF A CRANE

(75) Inventor: Aime Gaillard, La Clayette (FR)

(73) Assignee: Potain, Ecully (FR)

( * ) Notice: Subject to any disclaimer, the term of this patent is extended or adjusted under 35 U.S.C. 154(b) by 285 days.

(21) Appl. No.: 10/383,529

(22) Filed: Mar. 10, 2003

(65) Prior Publication Data

US 2003/0196982 A1 Oct. 23, 2003

(30) Foreign Application Priority Data

Apr. 12, 2002 (FR) ..... 02 04606

(51) Int. Cl.
*B66C 23/42* (2006.01)

(52) U.S. Cl. ..... 212/297; 212/292; 212/300

(58) Field of Classification Search ..... 212/297, 212/292, 300

See application file for complete search history.

(56) References Cited

U.S. PATENT DOCUMENTS 4,895,263 A * 1/1990 Saint Gerand ..... 212/297
6,439,408 B1 8/2002 Aquino et al.

FOREIGN PATENT DOCUMENTS

| | | | |
|---|---|---|---|
| EP | 0 733 583 A1 | * | 2/1996 |
| EP | 0 888 997 A1 | * | 1/1999 |
| FR | 2 546 496 A1 | * | 11/1984 |
| FR | 2 792 627 A | | 10/2000 |
| FR | 1 172 323 A | | 1/2002 |
| GB | 2 142 902 A | * | 1/1985 |

* cited by examiner

*Primary Examiner*—Thomas J. Brahan
(74) *Attorney, Agent, or Firm*—Oliff & Berridge, PLC

(57) ABSTRACT

The device applies to a crane having multiple functions, with a modifiable configuration, which comprises a foldable mast, composed of two elements, and a distributing jib, composed of a plurality of successive elements. This device comprises a double-acting jack connecting a lower rod assembly to an upper rod assembly. The lower rod assembly is connected to the lower part of the upper mast element and to the upper part of the lower mast element. The upper rod assembly is connected to the upper part of the upper mast element and to the jib foot.

6 Claims, 10 Drawing Sheets

DEVICE FOR RAISING AND UNFOLDING THE MAST AND FOR RAISING THE JIB OF A CRANE

BACKGROUND

The present invention is concerned with lifting or handling appliances and more particularly with cranes. This invention relates more specifically to a motorized device for raising and unfolding the mast and for raising the jib of a crane and even more particularly of a crane with a jib having multiple functions, such as is described by the document FR 2792627 A in the Applicant's name.

RELATED ART

The subject of this document is a crane of modifiable configuration which comprises a mast, mounted on a chassis, and a distributing jib, composed of successive elements articulated on one another about horizontal axes, the first jib element, called a jib foot, itself being articulated about a horizontal axis at the top of the mast. This first jib element and, if appropriate, the following element can be brought into a substantially vertical position, in alignment with the raised mast, so as to increase the height of this mast. All the jib elements comprise a rolling track for the same carriage. Thus, the crane may be used as a crane with a long or shortened, horizontal or inclined distributing jib or else as a crane with a "swan neck" jib, depending on the configuration of the jib elements, the height of the crane also being adjustable according to the number of jib elements brought into the prolongation of the mast.

In such a crane with a jib having multiple functions, the mast may itself be capable of being unfolded and being used in a plurality of positions, and the various configurations of the jib elements may thus be combined with the variable configurations of the mast. In particular, the foldable mast is composed of two mast elements, to be precise a lower mast element, articulated on the chassis of the crane, and an upper mast element, articulated on the top of the lower mast element. In particular, the lower mast element is articulated on a revolving chassis orientable about a vertical axis on a basic chassis mounted an wheels, the crane thus being capable of taking the form of an independent rolling appliance.

For motorizing the various joints of such a crane, the abovementioned document provides devices with a jack or with a jack and a rod assembly. This results in a multiplicity of jacks and of rod assemblies, bearing in mind the total number of joints to be motorized.

As another known example of the motorization of the unfolding of a foldable crane, mention may also be made of the document FR 2682096 A in the Applicant's name. This document is concerned with a crane which comprises is a foldable mast consisting of two elements and a jib consisting of two main elements. For such a crane structure, the motorized raising and unfolding device comprises a jack located between the two elements of the mast and articulated, on the one hand, on the lower part of the lower mast element and, on the other hand, on the lower part of the upper mast element by means of a rod assembly. The unfolding of the mast is carried out with the aid of this rod assembly. The raising of the jib is carried out with the aid of a tie connected, on the one hand, to a fixed point of the revolving chassis of the crane and, on the other hand, to a fixed point of the jib.

Such a technique has various disadvantages:

- The jack placed between the two mast elements possesses considerable bulk which is obstructive particularly in the folded transport position of the crane.
- The movements of the raining/unfolding of the mast and of the raising of the jib are simultaneous and do not make it possible to change configuration during the work of the crane, the working configuration being obligatorily predefined before the raising and unfolding of the crane.
- At all events, proceeding from this crane design, two motorization systems must be provided, to be precise; a system for raising and unfolding the mast and for raising the jib, since these movements are associated, and a system for unfolding the jib, and the device considered here cannot be applied directly to a crane with a jib having multiple functions.

SUMMARY

The present invention is aimed at avoiding the disadvantages set out above by providing an improved device for raising and unfolding the mast and for raising the jib of a crane, said device being more particularly suitable for a crane with a jib having multiple functions, this device comprising a minimum number of jacks capable of being used both for raising/unfolding and for the work of the crane, by making it possible to have various configurations of this crane, while at the same time possessing a small bulk, particularly for reducing the height of the crane in the folded transport position.

For this purpose, the subject of the invention is a motorized device for raising and unfolding the mast and for raising the jib of a crane of the type in question, this device comprising essentially a double-action hydraulic jack, the two ends of which are connected respectively to a lower rod assembly and to a upper rod assembly, the lower rod assembly intended for raising and unfolding the mast being also connected to the lower part of the upper mast element and to the upper part of the lower mast element, and the upper rod assembly intended for raising the jib and for moving it into various working positions being also connected to the upper part of the upper mast element and to the jib foot, the device also comprising at least one guy connecting the lower part of the upper mast element to a point of the chassis of the crane on which the lower part of the lower mast element is articulated, and means for locking the lower end of the abovementioned jack, in at least two separate positions, on the lower part of the upper mast element, and, finally, a stop located in the upper part of the upper mast element and provided for cooperating with the upper rod assembly.

Thus, the inventive idea involves providing a single jack, associated with two rod assemblies, for performing both the functions of unfolding/folding the mast, of raising/lowering the jib and of working with "luffing motion", that is to say with a jib raising movement. The two locking positions of the jack occur respectively in the "mast unfolded" position and in the "mast folded" position. The proposed system possesses simple and reliable kinematics: it does not entail either a combination of movements or manual action on its functioning. It also affords complete independence of the movements and positions of the mast and of the jib, thus allowing all possible configurations, particularly from a position with the mast folded substantially horizontally or from a position with the mast unfolded substantially vertically.

The need for a single jack for various movements or functions also leads to economical implementation. Moreover, the jack is not positioned between the two mast elements when these are folded, but, instead, it rests on the upper mast element, thus making it possible to increase the driver's angle of sight from his cab.

According to one embodiment of the device which is the subject of the invention, the lower rod assembly comprises a first rod, preferably a double rod, articulated at one or its ends on the corresponding end of the jack, articulated at an intermediate point on the lower part of the upper mast element and articulated at its other end on one end of a second rod, preferably a double rod, itself articulated at its other end on the upper part of the lower mast element.

As regards the upper rod assembly, the latter advantageously comprises a bent rod, preferably a double rod, articulated at one of its ends on the upper part of the upper mast element and articulated, at its other end, both on the corresponding end of the jack and on one end of another rod, preferably a single rod, the other end of which is articulated on the jib foot. The bent rod here allows the upper rod assembly to "bypass" the articulation of the jib foot on the top of the mast.

The means for locking the lower end of the jack on the lower part of the upper mast element comprise in a particular embodiment:

- on the one hand, at the lower end of the jack, a transverse bolt consisting of a double-acting auxiliary jack, the body and stem of which are respectively integral with two opposite axles mounted slideably in the respective lateral parts of a head of the main jack, a safety spring being provided for keeping the bolt in the active position;
- on the other hand, on the lower part of the upper mast element, a guide assembly composed of two slideways which are parallel to this mast element and are equipped respectively with lower and upper broaching holes corresponding to one another, the head of the jack being mounted displaceably between the two slideways, the lower broaching holes of which are provided for receiving respectively the two axles of the bolt in the "mast folded" position and the upper broaching holes of which are provided for receiving respectively the two axles of the bolt in the "mast unfolded" position.

The locking means have the function of not introducing useless stresses into the lower rod assembly, particularly by preventing the rotation of the first rod (three-point) of this rod assembly in the folded transport position.

The main jack makes it possible not only to raise the mast and the jib foot when the crane is initially being put in place, but also to obtain all intermediate jib positions via control of the greater or lesser extension of the stem of this jack. Inasmuch as the jib is itself composed of two or more elements articulated on one another, the unfolding of these jib elements in relation to one another is obtained by means of auxiliary motorization, in particular by jack and rod assembly, with which the present invention is not directly concerned.

BRIEF DESCRIPTION OF THE DRAWINGS

The invention will be understood more clearly from the following description, with reference to the accompanying diagrammatic drawing illustrating, by way of example, one embodiment of this device for raising and unfolding the mast and for raising the jib of a crane.

DETAILED DESCRIPTION OF PREFERRED EMBODIMENTS

Figure 1:
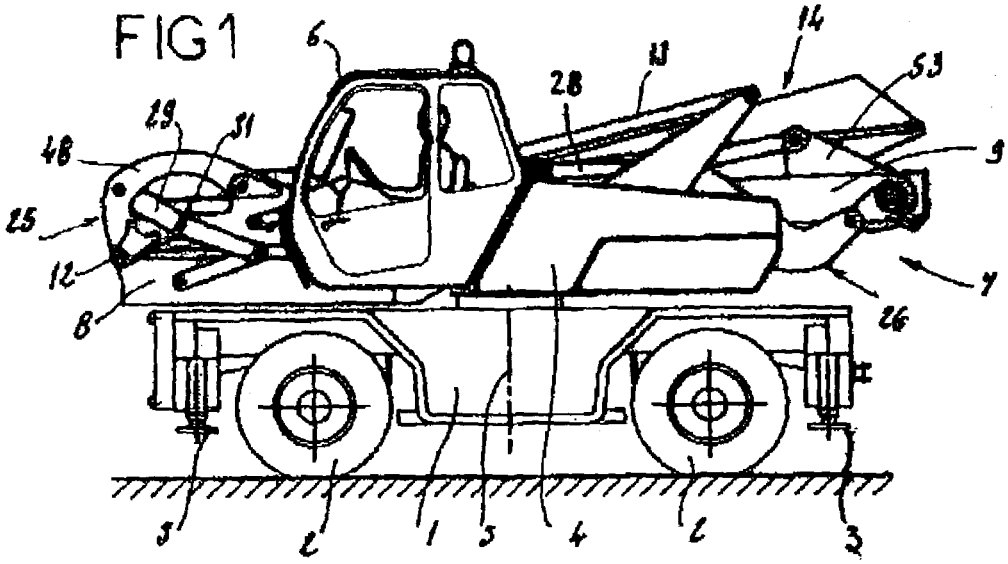
FIG. 1 is a side view of a crane equipped with the device according to the invention, in folded transport position.

The crane illustrated in the drawing in various positions possesses a basic carrying chassis 1 mounted so as to roll on wheels 2 and provided with stabilizers 3. Mounted on the basic chassis 1 is a revolving chassis 4 orientable about a vertical axis 5 and provided with a driver's cab 6 on one of its sides.

On the other side of the revolving chassis 4 is mounted a foldable mast 7 composed of a lower mast element a and of a upper mast element 9, each of polygonal cross section and of caisson-type structure The lower mast element 8 is articulated by means of its base, about a horizontal axis 10 on a lower part of the revolving chassis 4. The upper mast element 9 is articulated by means of its base, about a horizontal axis 12, on the top of the lower mast element 8, this intermediate joint of the mast 7 allowing a relative pivoting of the elements 8 and 9 through an angle of approximately 180°.

The foldable mast 7 is held by means of a double guy 13 which connects the base of the upper mast element 9 to the upper part of the revolving chassis 4.

At its top, the foldable mast 7 carries a distributing jib 14 which is composed of three successive jib elements 15, 16 and 17, each of caisson-type structure, which all three comprise, level with their lower face, a rolling track 18 for a jib carriage 19.

The first jib element 15, also called a jib foot, is articulated at its rear end, about a horizontal axis 20, at the top of the upper mast element 9, this joint allowing a relative pivoting through an angle of approximately 180°. The second jib element 16 is articulated by means of its rear end, about a horizontal axis 21, on the front end of the jib foot 15. The third jib element 17, also designated as the jib point, is articulated by means of its rear end, about a horizontal axis 22, on the front end of the second jib element 16.

The crane is provided with a motorized device, designated as a whole by 23, for raising and unfolding its mast 7 and for raising its jib 14. The device 23 comprises a hydraulic jack 24, a lower rod assembly 25 and an upper rod assembly 26.

The hydraulic jack 24, which is a double-acting jack, possesses a body 27, the end of which is connected to the lower rod assembly 25, and a stem 26, the end of which is connected to-the upper rod assembly 26.

The lower rod assembly 25 comprises a three-point double rod 29 which is articulated:

- at one of its ends, about an axis 30, on the end of the body 27 of the jack 24;
- at an intermediate point along its length, about an axis 31, on the lower part of the upper mast element 9;

at its other end, about an axis 32, on one end of another double rod 33.

At its other end, the double rod 33 is articulated, about an axis 34, on the upper part of the lower mast element 8.

The upper rod assembly 26 comprises a bent double rod 35 which is articulated:

at one of its ends, about an axis 36, on the upper part of the upper mast element 9;

at its other end, about an axis 37, both on one end of a single rod 38 and on the end of the stem 28 of the jack 24.

The single rod 38 is articulated at its other end, about an axis 39, on the jib foot 15.

The abovementioned double guy 13 also participates in the raising and unfolding device 23 by forming a deformable quadrilateral with: the lower part of the upper mast element 9, the whole of the lower mast element 8 and the revolving chassis 4.

Figure 12:
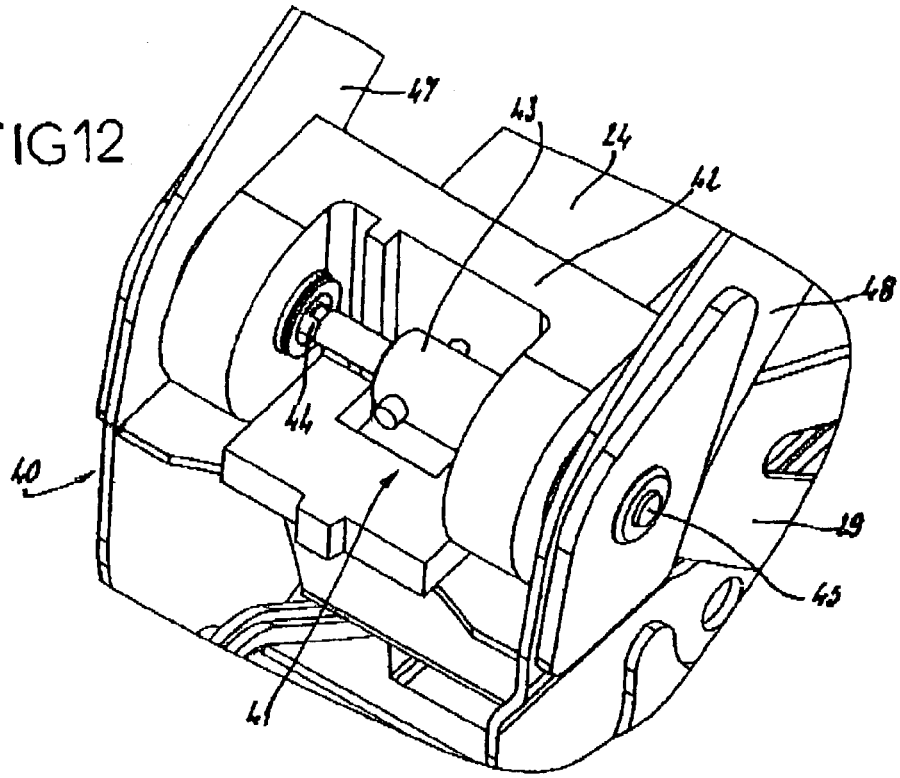
FIG. 12 shows, in perspective, in large detail A of FIG. 11, relating to the locking means of the jack.
Figure 14:
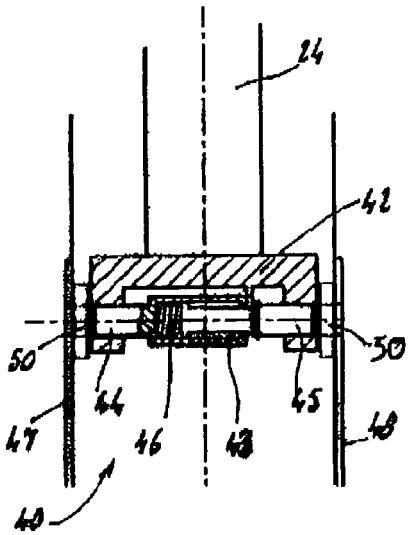
FIGS. 13 and 14 are sectional views of these locking means in two positions.
Figure 13:
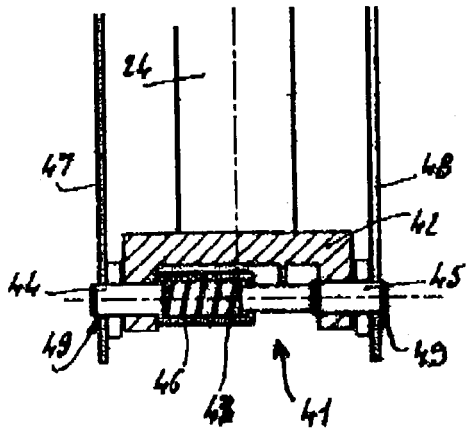

The device 23 also comprises a system 40 for locking the lower end of the jack 24, that is to say the end of the body 27 of this jack 24, this locking system 40 0being located at the base of the upper mast element 9 and being illustrated more particularly in FIGS. 12 to 14.

The locking system 40 comprises a bolt 41 located at the end of the body 27 of the jack 24, said end forming a widened head 42. The bolt 41 is composed:

of a double-acting auxiliary hydraulic jack 43 arranged transversely;

of two opposite axles 44 and 45 integral respectively with the body and with the stem of the auxiliary jack 43 and mounted slideably in the lateral parts of the jack head 42;

of a safety spring 46 integrated into the auxiliary jack 43 and acting in the direction of extension of the stem of this jack, that is to say in the direction of separation of the two axles 44 and 45.

The locking system 40 also comprises a guide assembly composed of two parallel slideways 47 and 48 carried by the upper mast element 9 and also extending parallel to this mast element 9. The two slideways 47 and 48 are equipped with broaching holes corresponding to one another, which comprise, on the one hand, a pair of lower broaching holes 49 and, on the other hand, a pair of upper broaching holes 50. The two axles 44 and 45 of the bolt 41 are intended to be engaged into the lower broaching holes 49 (in the "mast folded" position) or into the upper broaching holes 50 (in the "mast unfolded" position), the jack head 42 being mounted displaceably between the two slideways 47 and 48.

Finally, the device 23 comprises a stop 51 located at the top of the upper mast element 9 (see FIGS. 2 and 3) and cooperating with the upper rod assembly 26, more particularly with the bent double rod 35, so as to effect a stopping of rotation of this rod 35 in certain operating phases.

The operation of the device 23 is established, as follows, starting from the folded crane transport position (FIG. 1):

Initially, the crane is folded on the revolving chassis 4, and this revolving chassis 4 is itself locked in terms of orientation on the basic chassis 1. The assembly consisting of the folded mast 7 and of the folded jib 14 takes its place at the side of the driver's cab 6. The stem 28 of the jack 24 is partially extended.

Figure 2:
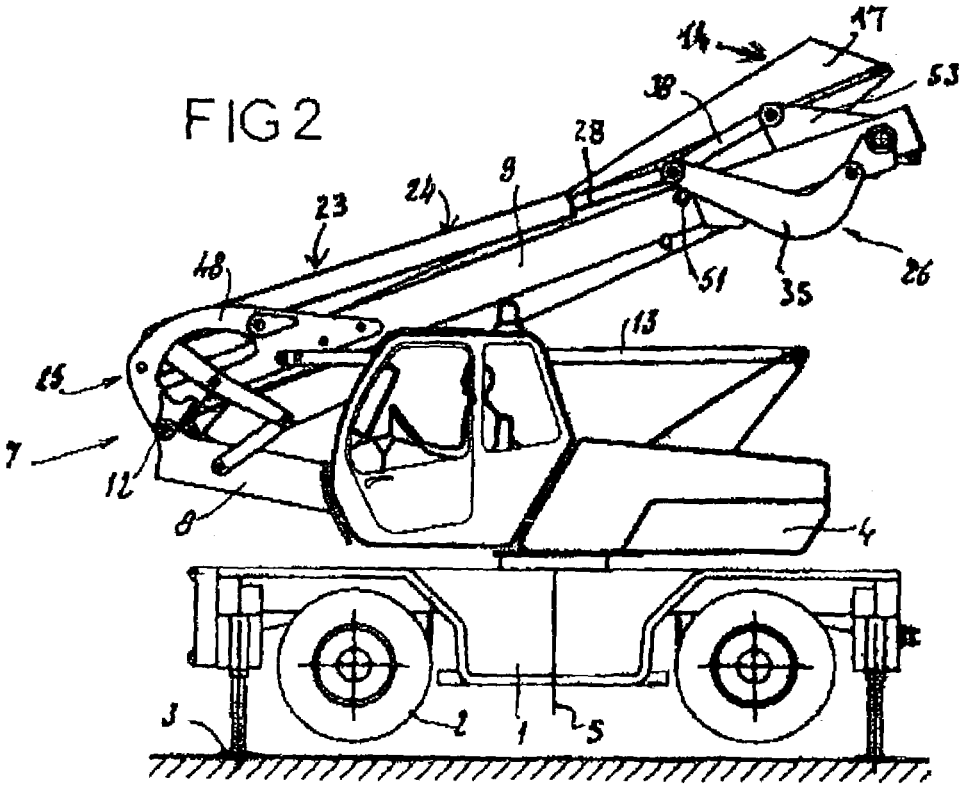
FIGS. 2, 3, 4, 5 and 6 are aide views, similar to FIG. 1, illustrating successive phases in the raising and unfolding the mast and in the raising of the jib of this crane.
Figure 3:
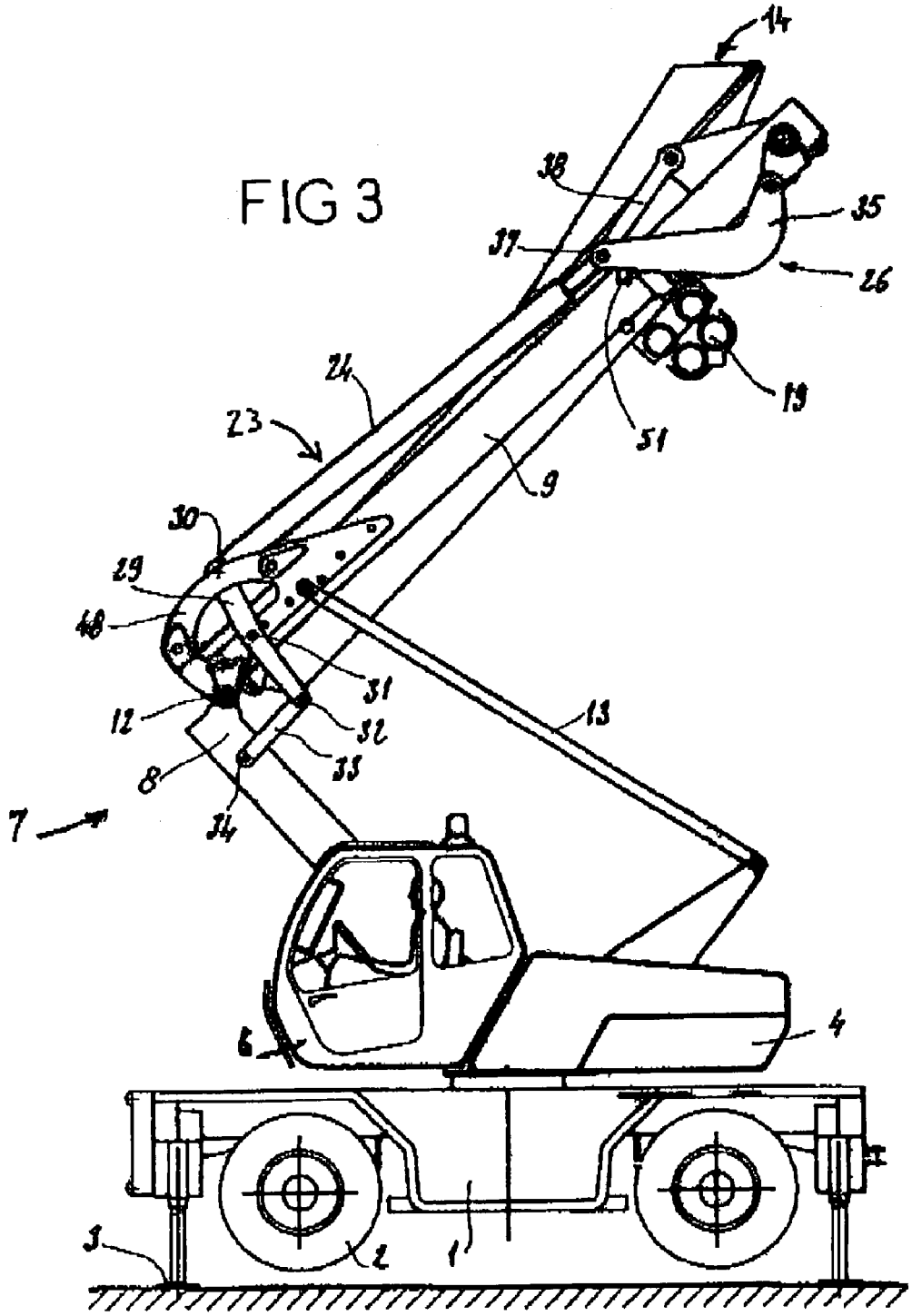
Figure 4:
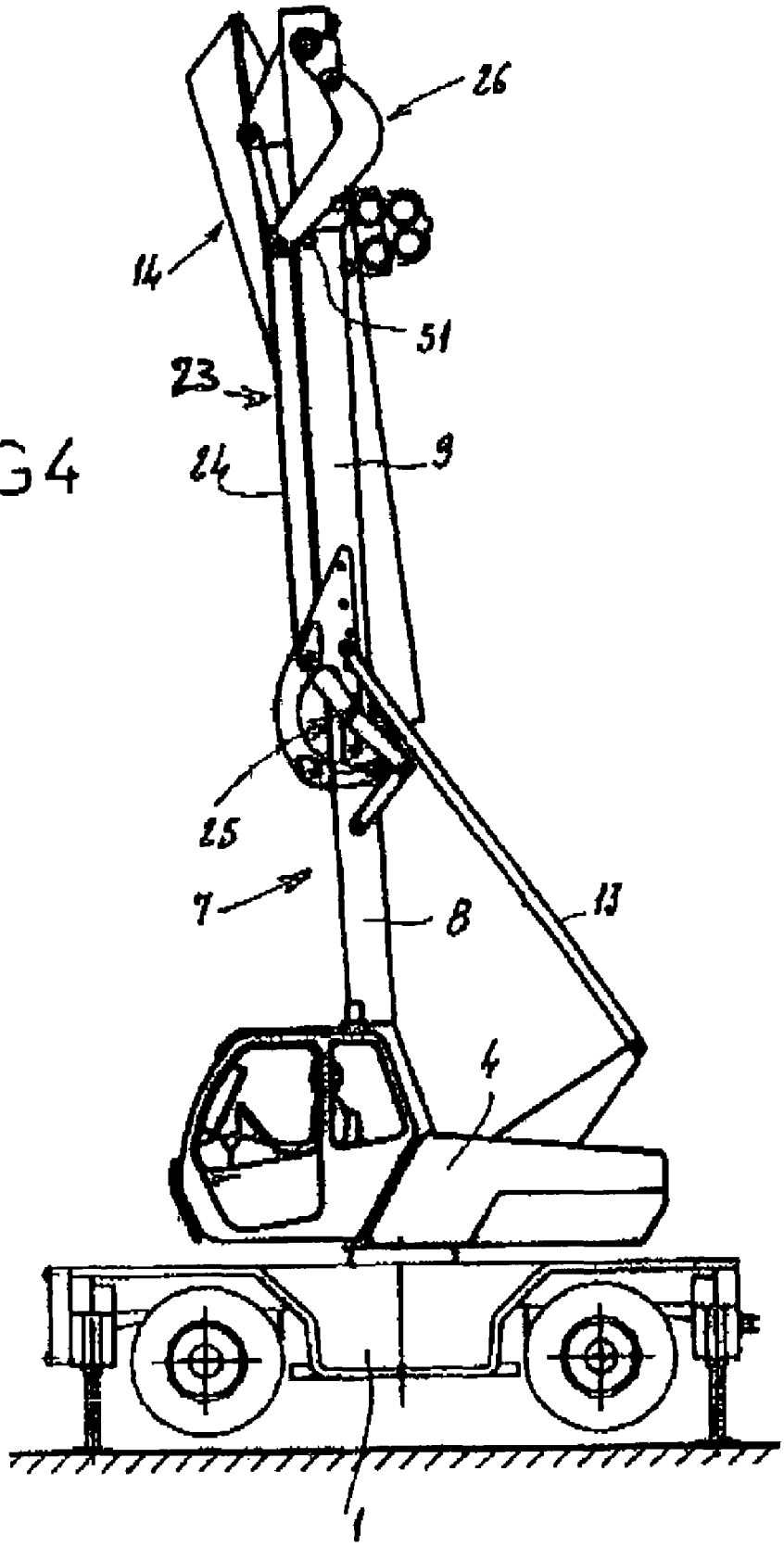

Starting from this position, the raising and unfolding of the mast 7 are carried out first of all, as shown in FIGS. 2 to 4. For this purpose, the jack 24 is controlled in the direction of the retraction of its stem 28, thus actuating the lower rod assembly 25 by causing the rods 29 and 33 or the latter to pivot, while the upper rod assembly 26 remains in bearing contact on the stop 51. This movement brings about the simultaneous raising and unfolding of the two mast elements 8 and 9, likewise with the aid of the above-mentioned deformable quadrilateral, one of the sides of which consists of the double guy 13. FIGS. 2 and 3 show intermediate positions during raising and unfolding, while FIG. 4 shows the final position obtained when the stem 28 of the jack 24 is retracted completely. The two mast elements 8 and 9 have then come into abutment against one another by means of bearing plates located respectively at the top of the lower mast element 8 and at the base of the upper mast element 9. These two mast elements 8 and 9 are thus detained in the aligned position. The jib 14, up to then, remains folded against the mast 7.

The action of the locking system 40 during the phase described above will now be described:

Initially, (FIGS. 1, 12 and 13), with the mast 7 folded, the bolt 41 is locked by means of its axles 44 and 45 in the lower broaching holes 49 of the slideways 47 and 48, thus fixing the relative position of the two mast elements 8 and 9 by means of the lower rod assembly 25. Before the mast 7 is unfolded, the auxiliary jack 43 is actuated in the direction of the retraction of its stem, and its "stem retracted" position is maintained between the slideways 47 and 48 —see FIG. 14.

When the crane reaches the "mast unfolded" position (FIG. 4), the bolt 41 is locked by means of its axles 44 and 45 in the upper broaching holes 50 of the slideways 47 and 48, thus fixing the new relative position of the two mast elements 8 and 9, still by means of the lower rod assembly 25.

Figure 5:
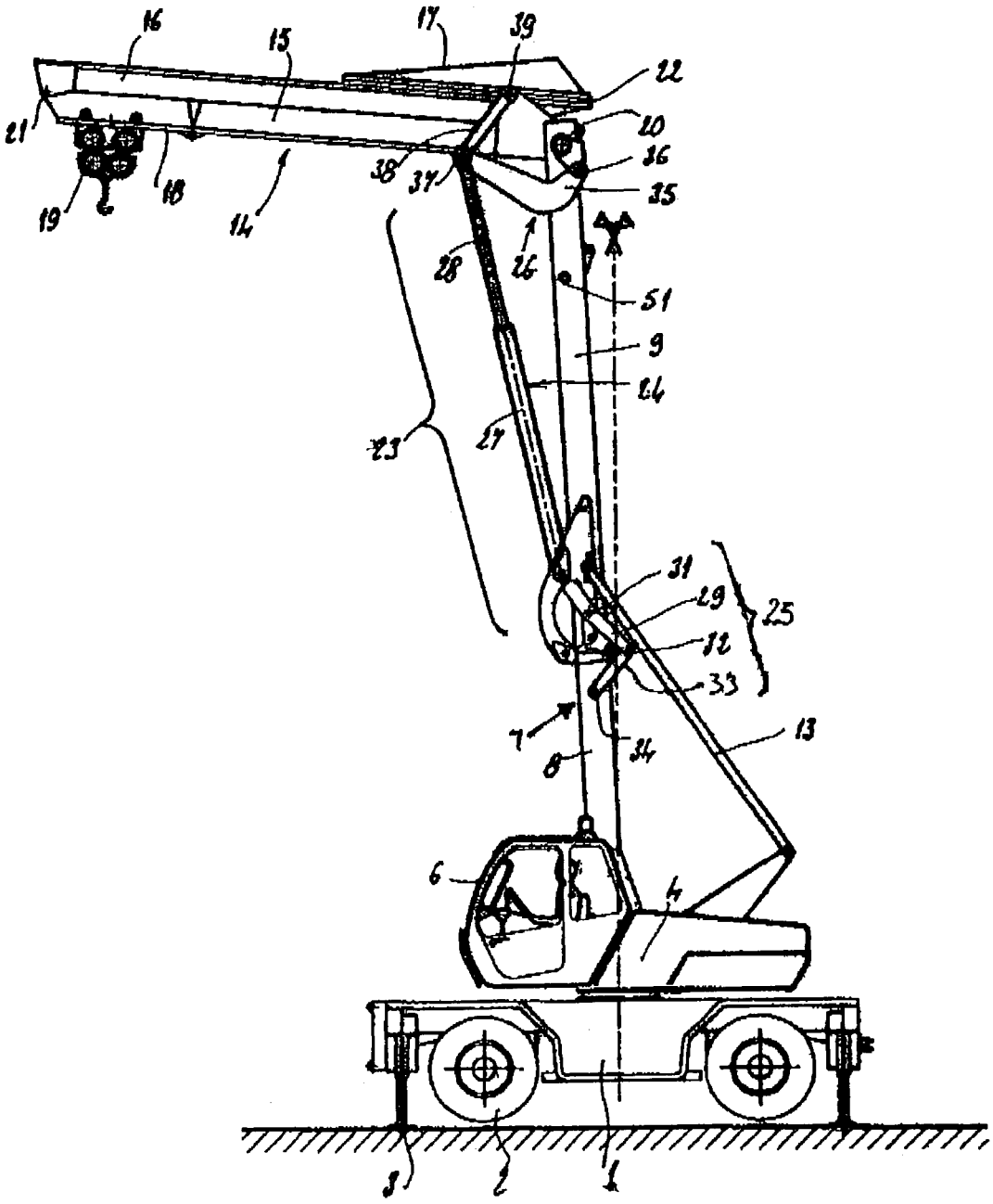

Starting from this position, the raising and unfolding of the jib 14 are carried out, commencing with the raising of the jib foot 15. For this purpose, the jack 24 is controlled in the direction of extension of its stem 28, thus actuating the upper rod assembly 26 and causing the raising of the jib foot 15 into a substantially horizontal position, in fact a position slightly inclined upward (for example, at an angle of approximately 5°)—see FIG. 5. The intermediate element 16 of the jib 14 and the jib point 17 then remain folded on the jib foot 15.

Figure 6:
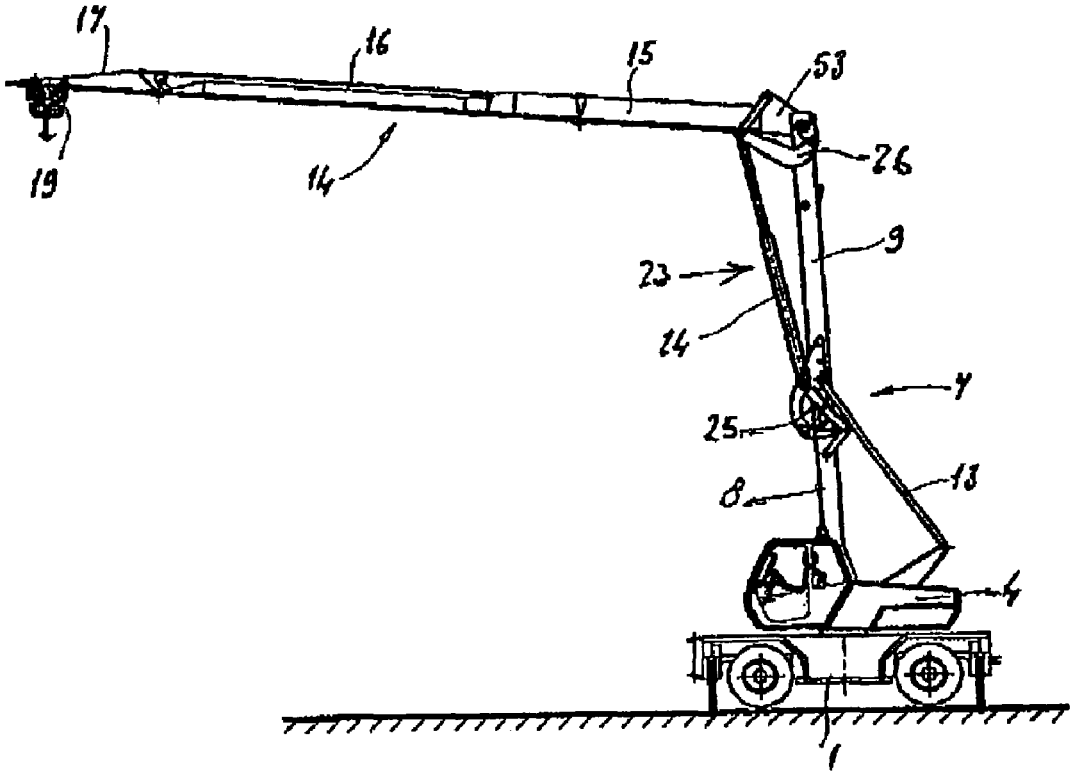

Finally, the complete unfolding of the jib 14 up to the alignment of its three elements 15, 16 and 17 is obtained by means of auxiliary motorization, not illustrated, by jack and rod assembly. The crane thus assumes a working configuration, with its jib 14 substantially horizontal (FIG. 6).

Figure 7:
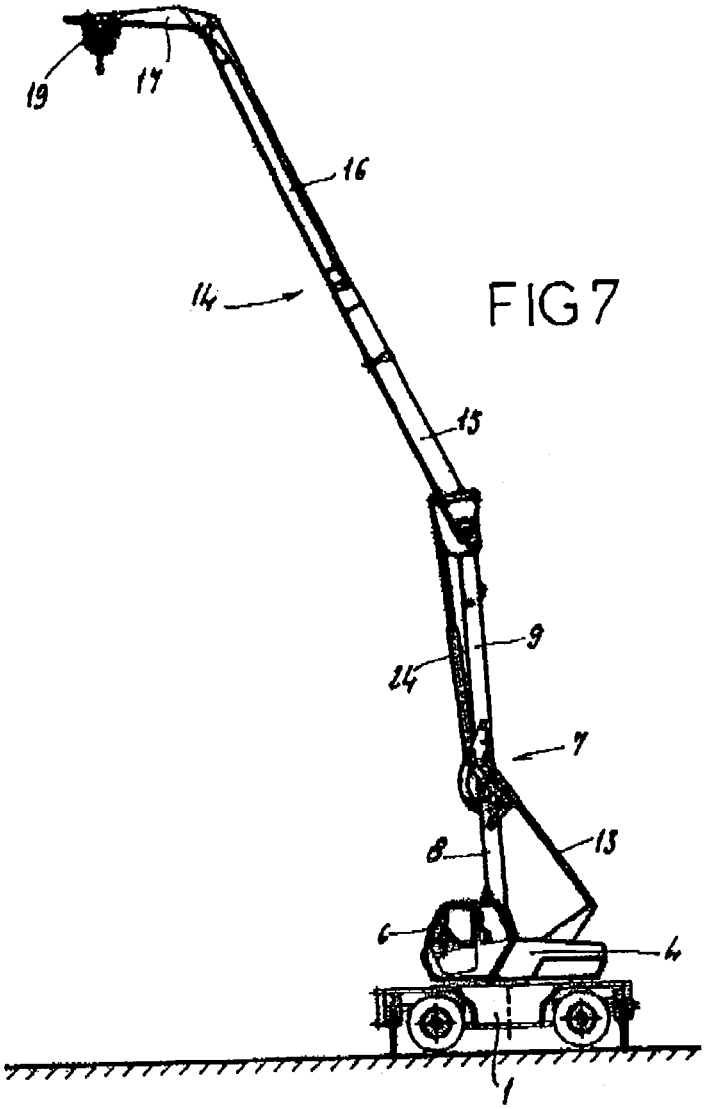
FIGS. 7, 8 and 9 are side views of the same crane in various working positions.
Figure 8:
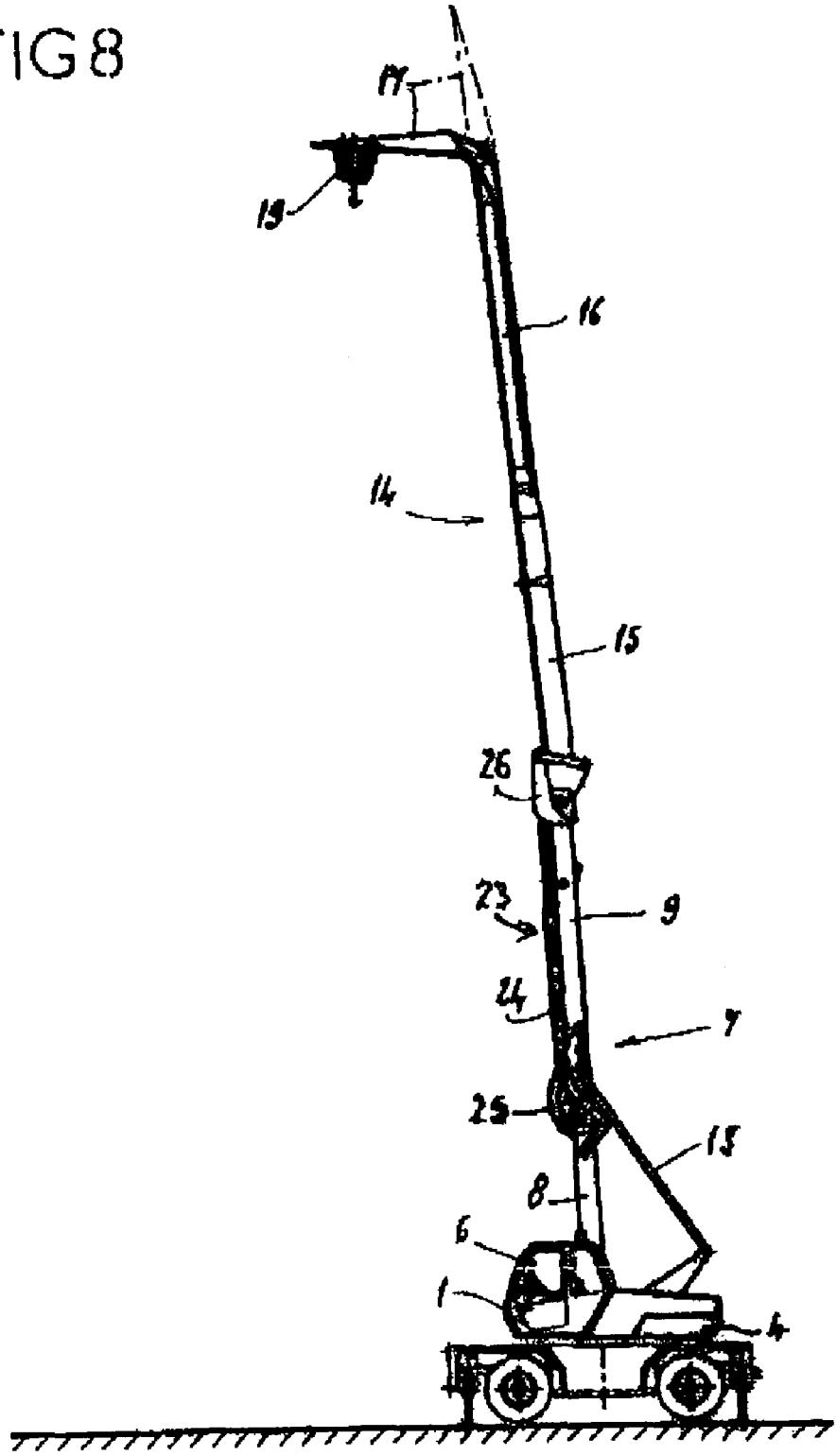
Figure 10:
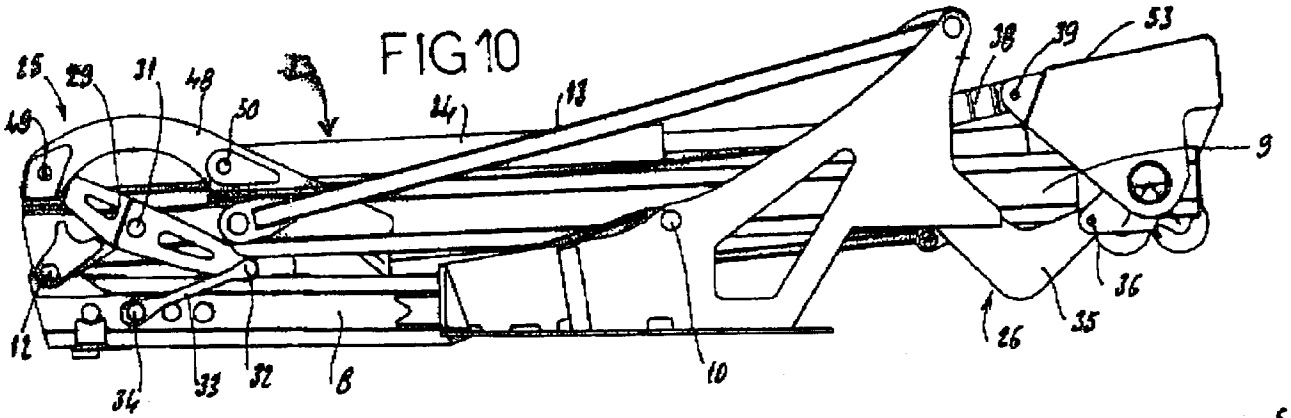
FIG. 10 is a side view of the raising and unfolding device according to the invention, illustrated alone and in more detail, in the folded position.
Figure 11:
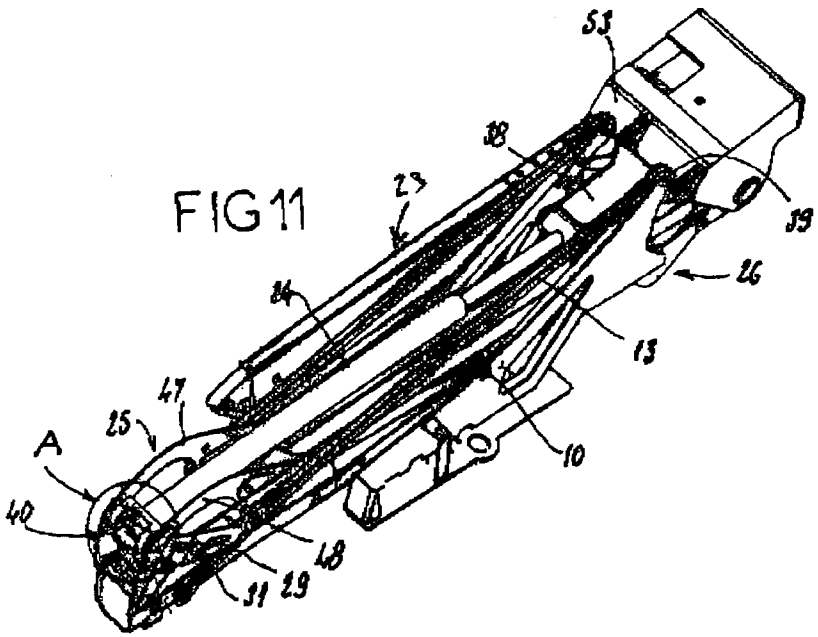
FIG. 11 is a perspective view corresponding to FIG. 10.

Other working positions of the crane are obtained by means of the control of the jack 24 in the direction of extension of its stem 28:

All intermediate jib positions, such as that of FIG. 7, the jib 14 remaining aligned, may be obtained between the substantially horizontal position (FIG. 6) and a substantially vertical position (FIG. 8).

The substantially vertical position of the jib 14 (FIG. 8) is reached when the stem 28 of the jack 24 comes into abutment in the extension limit position.

The folding and lowering of the jib 14, and then of the mast 7, up to the return to the folded transport position are obtained by means of maneuvers opposite to those described above.

The operations of raising and unfolding the mast 7 and the jib 14 and the opposite folding and lowering operations are carried out to an automatic cycle governed by a control/command unit comprising a computer. The latter triggers the sequence of movement commands, taking into account information supplied by the set of sensors, for example force, position and speed sensors, in order to execute a cycle of preprogrammed movements, each phase of which is monitored by sensors which permit the command of the following phase or not.

Figure 9:
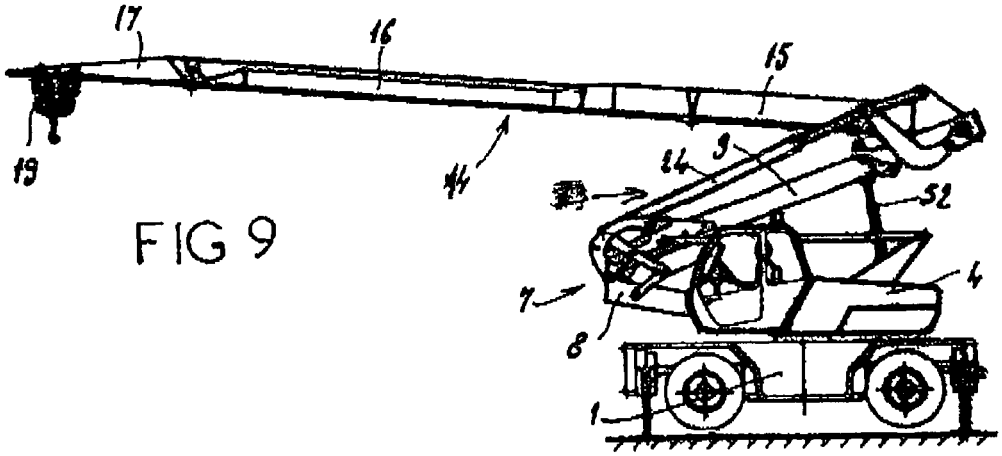

The crane may also be used in another configuration, illustrated in FIG. 9, in which its mast 7 is partially unfolded and brought to bear on the revolving chassis by means of a rear prop 52. This configuration allows a distribution of the loads which is associated with a possibility of displacement of the basic carrying chassis 1, for example for the loading and unloading of trucks.

Figure 15:
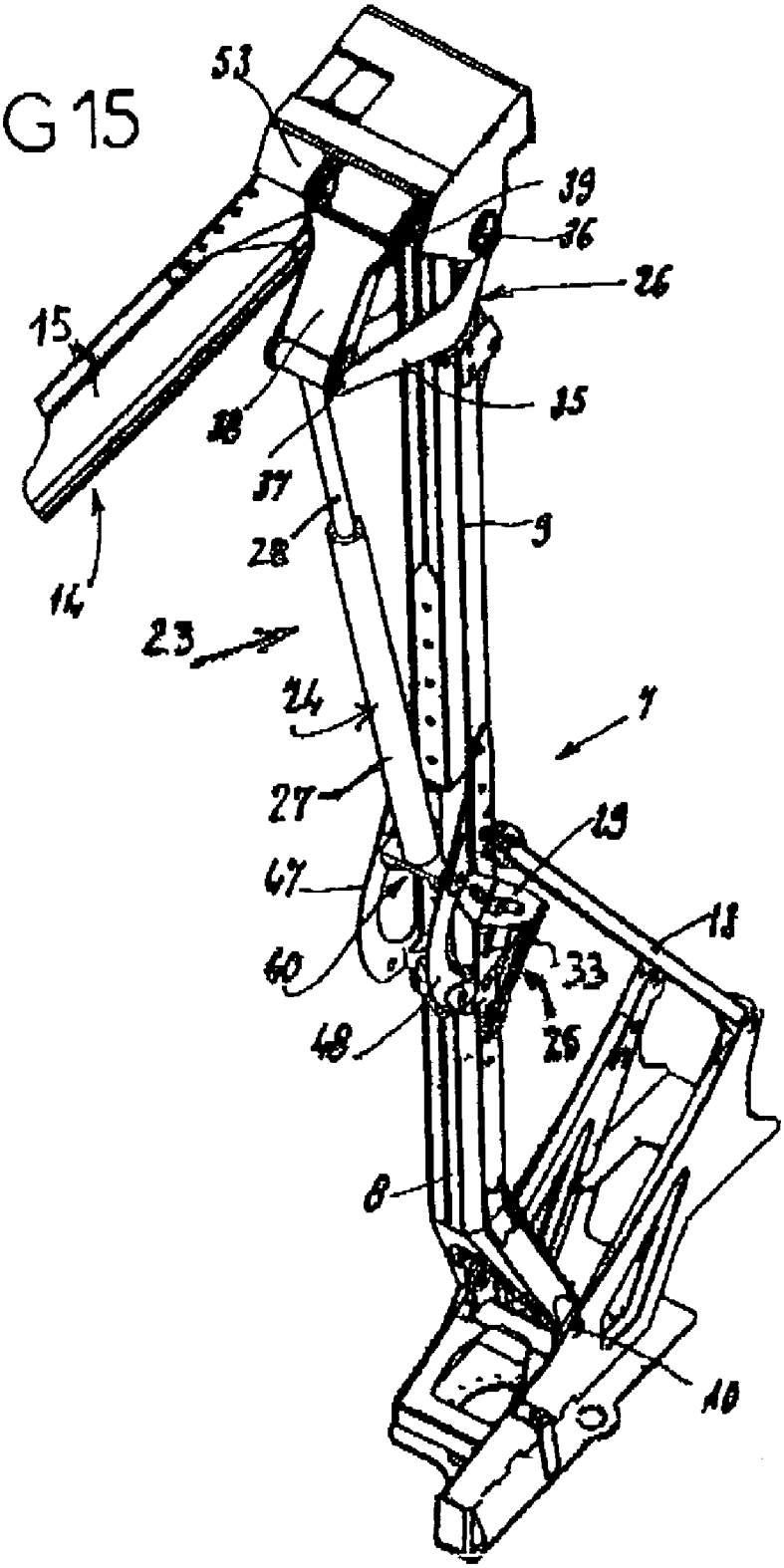
FIG. 15 is a perspective view of the device, in the unfolded position.

Finally, referring to FIG. 15, the longitudinal axis of the jib 14 is advantageously offset laterally with respect to the longitudinal axis of the mast 7 and also with respect to the device 23, the jib foot 15 thus being located at the side of the upper rod assembly 26. The single rod 38 of the upper rod assembly 26 is articulated about an axis 39 integral with yokes of a crossmember 53 welded laterally to the jib foot 15. By virtue of this lateral offset, an additional gain in lateral visibility is obtained for the driver stationed in the driver's cab 6 when the crane is in the folded transport position.

There will be no departure from the scope of the invention, as defined in the accompanying claims:

by modifying the structural details of the device, for example of its rod assemblies, by producing the mast and the jib elements in the form of structures of any shape and cross section, for example with a lattice-type structure instead of a caisson-type structure;

by modifying the number of successive elements of the jib;

by applying the device to a crane mounted on a basic chassis or other carrying element of any type and of any form, whether rolling or not;

by providing, on the crane, any arrangement of driver's cab or station which may differ from the particular example illustrated.

What is claimed is:

1. A motorized device for manipulating extensible elements of a crane, the crane having a foldable mast comprising a lower mast element, including a top portion and a bottom portion articulated to a chassis of the crane; an upper mast element, including a top portion and a bottom portion articulated to the top portion of the lower mast element; and a distributing jib having a plurality of successive jib elements articulated to one another, wherein a first jib element is articulated to the top portion of the upper mast element, at least the first jib element is capable of being brought into a substantially vertical position in alignment with the foldable mast when raised so as to increase a height of the mast, and the plurality of jib elements form a rolling track for a jib carriage, the motorized device comprising:

a hydraulic jack having a body and a stem;

a lower rod assembly connected to the body, the lower rod assembly comprising a first rod articulated at a first point about an axis disposed on a first end of the body, articulated at an intermediate point about an axis on the bottom portion of the upper mast element, and articulated at a third point about an axis disposed on a second rod connected to the top portion of the lower mast element;

an upper rod assembly connected to the stem, the upper rod assembly comprising a third rod articulated at a first end about an axis disposed on the top portion of the upper mast element, and articulated at a second end about an axis disposed on an end of a fourth rod and an end of the stem, wherein the fourth rod is articulated about an axis disposed on the first jib element;

at least one rod connected to the bottom portion of the upper mast element and connected to the chassis of the crane;

a locking system disposed at the bottom portion of the upper mast element for securing the hydraulic jack at a desired position; and a stop disposed at the top portion of the upper mast element to inhibit rotation of the third rod of the upper rod assembly.

2. The device according to claim 1, wherein the first rod is a three point double rod and the second rod is a double rod.

3. The device according to claim 2, wherein the locking system comprises:

a transverse bolt disposed at the bottom end of the lower mast element, wherein the bolt includes a double-acting auxiliary jack arranged transversely within the bolt;

two opposing axles connecting the auxiliary jack and the bolt;

a safety spring mounted transversely in a direction of extension of the auxiliary jack within the locking system to maintain the bolt in an active position; and a guide assembly including two parallel slideways connected to the upper mast element and extending parallel to the upper mast element, wherein the slideways have a plurality of through-holes to engageably receive the axles thereby securing the hydraulic jack at the desired position.

4. The device according to claim 1, wherein the third rod is a bent double rod and the fourth rod is a single rod.

5. The device according to claim 4, wherein the locking system comprises:

a transverse bolt disposed at the bottom end of the lower mast element, wherein the bolt includes a double-acting auxiliary jack arranged transversely within the bolt;

two opposing axles connecting the auxiliary jack and the bolt;

a safety spring mounted transversely in a direction of extension of the auxiliary jack within the locking system to maintain the bolt in an active position; and a guide assembly including two parallel slideways connected to the upper mast element and extending parallel to the upper mast element, wherein the slideways have a plurality of through-holes to engageably receive the axles thereby securing the hydraulic jack at the desired position.

6. The device according to claim 1, wherein the locking system comprises:

a transverse bolt disposed at the bottom end of the lower mast element, wherein the bolt includes a double-acting auxiliary jack arranged transversely within the bolt;

two opposing axles connecting the auxiliary jack and the bolt;

a safety spring mounted transversely in a direction of extension of the auxiliary jack within the locking system to maintain the bolt in an active position; and a guide assembly including two parallel slideways connected to the upper mast element and extending parallel to the upper mast element, wherein the slideways have a plurality of through-holes to engageably receive the axles thereby securing the hydraulic jack at the desired position.

* * * * *